US006761200B2

(12) United States Patent
Shinya

(10) Patent No.: US 6,761,200 B2
(45) Date of Patent: Jul. 13, 2004

(54) COATING TRANSFER DEVICE

(75) Inventor: Masashi Shinya, Kasukabe (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 10/428,123

(22) Filed: May 2, 2003

(65) Prior Publication Data

US 2003/0205332 A1 Nov. 6, 2003

(30) Foreign Application Priority Data

May 2, 2002 (JP) ..... 2002-130910

(51) Int. Cl.[7] ..... B32B 31/00

(52) U.S. Cl. ..... 156/577; 156/579; 118/76; 118/257; 242/160.4; 242/171

(58) Field of Search ..... 156/577, 574, 156/579, 523, 527, 540, 238; 118/200, 257, 76; 242/160.2, 170, 160.4, 171, 588.2, 588, 588.3, 588.6; D19/67, 69

(56) References Cited

U.S. PATENT DOCUMENTS 6,422,284 B1 * 7/2002 Kelders et al. ..... 156/540

FOREIGN PATENT DOCUMENTS

JP 10-181288 7/1998
JP 10-324092 12/1998

* cited by examiner

*Primary Examiner*—Richard Crispino
*Assistant Examiner*—Cheryl N. Hawkins
(74) *Attorney, Agent, or Firm*—Sughrue Mion, PLLC

(57) ABSTRACT

A device for transferring a coating onto a paper or like surface from the outer surface of a transfer tape extending around a transfer head protruding from a casing and having a pair of transversely spaced apart guide members. A protective cover is held within the casing when the device is used and has a front end portion adapted to protrude from the casing for protecting the coating on the unused portion of the transfer tape when the device is out of use. The cover has an engaging portion formed on the inner surface of its front end portion for engaging with the bottom edges of the guide member at its front end to hold the cover in its position in which the device is out of use, while the engaging portion is engageable with a supporting portion formed on the casing to hold the cover in its position in which the device is in use.

5 Claims, 3 Drawing Sheets

COATING TRANSFER DEVICE

FIELD AND BACKGROUND OF THE INVENTION

This invention relates to a coating transfer device, and more particularly, to an improved coating transfer device having a cover for protecting a coating on a transfer tape when it is out of use.

There is known a coating transfer device used for transferring a coating, such as a layer of a correcting material, or paste, onto e.g. a paper surface from the outer surface of a transfer tape extending around a transfer head protruding from a casing. The coating, however, is easily spoiled as it is exposed on the outer surface of the transfer tape even when the device is not in use. It is, therefore, usual to employ a removable cap for covering the whole transfer head including the transfer tape, or a cap supported rotatably at one end on the casing for covering that portion of the transfer head along which the unused transfer tape portion extends. In the former case, however, the removable cap is not only likely to get lost easily during the use of the device, but is also costly as it is made to cover the whole transfer head. In the latter case, the cap is not only likely to break easily at its portion supported rotatably on the casing, but also calls for a complicated and costly mold for making a mechanism for supporting it rotatably.

OBJECTS OF THE INVENTION

It is an object of the present invention to provide an improved coating transfer device having a cover for protecting a coating on a transfer tape when the device is not in use. It is a further object of the invention to provide a coating transfer device having a cover which can be manufactured at reasonable cost. It is still another object of the invention to provide a coating transfer device having a cover without relying upon any cap that can get lost during use of the device, or any rotatable or like means that can easily break.

SUMMARY OF THE INVENTION

These and other objects are attained in accordance with the present invention by a coating transfer device for transferring a coating onto a paper or like surface from the outer surface of a transfer tape extending around a transfer head protruding from a casing and having a pair of transversely spaced apart guide members having bottom edges, wherein a stopper function is rendered by having a protective cover held in the casing when the device is used to transfer, and having a front end portion adapted to protrude from the casing for protecting the coating on an unused portion of the transfer tape when the device is out of use, said cover having an engaging portion formed on the inner surface near the front end portion thereof for engaging with the bottom edges of said guide members at a front end portion thereof to hold the cover in its position in which the device is out of use, while the engaging portion is engageable with a supporting portion formed on the casing to hold the cover in its position in which the device is in use.

There is no fear of the cover being easily lost, since it is held by the casing when the device is used, while its front end portion protrudes to protect the coating on the unused portion of the transfer tape when the device is not used. There is no fear of the cover failing easily, either, since no rotary or like mechanism that is easily broken is used to attach the cover to the casing. The absence of any such mechanism also makes the device less expensive to manufacture. Moreover, the cover is reliably held in position both when the device is used, and when it is not used. There is no fear of the cover sliding inadvertently and hindering the use of the device, while it protects the coating on the transfer tape completely when the device is not used.

According to a preferred embodiment of the invention the engaging portion comprises a projection engaging with each guide member to cause the front end portion of the cover to be elastically curved away from the transfer tape to maintain an appropriate distance between the inner surface of the front end portion of the cover and the tape. This arrangement ensures that the inner surface of the front end portion of the cover does not contact and damage the coating on the transfer tape.

According to another embodiment of the invention the cover has a width which is larger than the distance between the guide members and the engaging member has a transversely extending length which is larger than the distance between the guide members. The cover extends over the whole distance between the two guide members and is still more effectively held in its position in which the device is not used, thereby ensuring the still more effective protection of the coating on the transfer tape.

According to a further embodiment of the invention the supporting portion is formed on the bottom of the casing which faces the inner surface of the cover. Thereby cover is still more effectively held in its position in which the device is used.

Finally according to a further embodiment of the invention each guide member has on its bottom edge a projection which is engageable with the engaging portion of the cover. The cover has its front end portion curved away from the transfer tape still more easily and thereby ensures the still more effective protection of the coating on the tape.

BRIEF DESCRIPTION OF THE DRAWINGS

The invention will be explained in more detail hereinafter with reference to the drawings and embodiments thereof. In the drawings.

DETAILED DESCRIPTION OF PREFERRED EMBODIMENTS OF THE INVENTION

Figure 1:
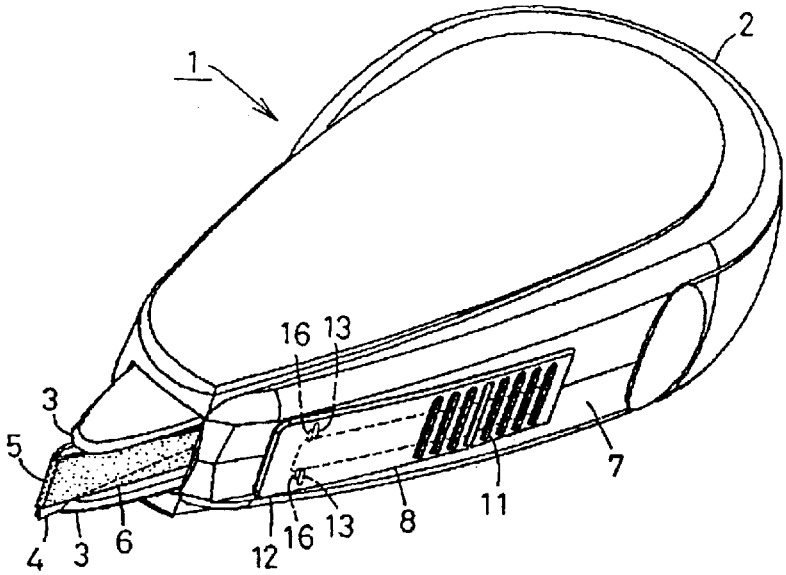
FIG. 1 is a perspective view of a coating transfer device according to the invention, shown in a position when it is used.
Figure 2:
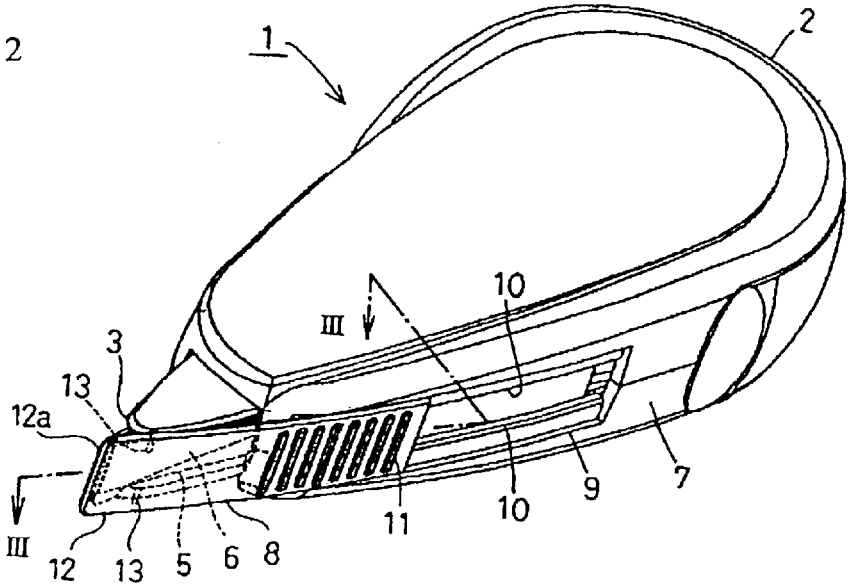
FIG. 2 is a view similar to FIG. 1, but showing the device in a position when it is not used.
Figure 3:
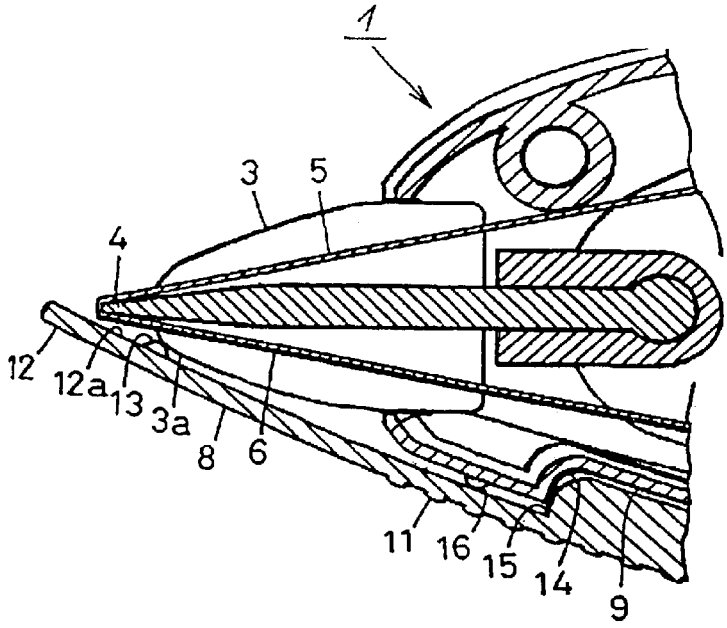
FIG. 3 is an enlarged sectional fragmentary view taken along the line III—III in FIG. 2, showing a transfer head and its vicinity when the device is not used.

Referring first to FIGS. 1 to 3, a coating transfer device 1 according to one embodiment of the invention has a casing 2 and a transfer head 4 protruding from the front end of the casing 2 and having a pair of transversely spaced apart guide members 3. A transfer tape 5 extends around the transfer head 4 and carries a film-like coating 6, e.g. made of a correcting material, or paste, on its outer surface. When the device 1 is used, it is held upright so that its rightside bottom portion as viewed in FIG. 1 may face downward, the transfer head 4 is pressed at its front edge against a paper or like substrate surface, and the device 1 is drawn thereby the transfer tape 5 may slide clockwise past the front edge of the transfer head 4 to transfer the coating 6 onto the paper or like surface.

According to a salient feature of this invention, the device 1 includes a protective cover 8 formed from an elongated sheet material and attached longitudinally slidably to a bottom portion 7 of the casing 2 which faces downward when the device 1 is used. The cover 8 has a width which is slightly larger than the lateral distance between the guide members 3 of the transfer head 4. The cover 8 lies along the bottom portion 7 of the casing 2, as shown in FIG. 1, when the device 1 is used, and when the device 1 is not used, the cover 8 can be advanced to protrude from the casing 2 so that its front end portion 12 may cover an unused portion of the transfer tape 5 for protecting the coating 6 thereon, as shown in FIG. 2.

The casing 2 has a longitudinal recess 9 formed in a bottom portion 7 of the casing and comprising a pair of transversely spaced apart guide rails 10 formed therein, as shown in FIG. 2. The cover 8 has a pair of transversely spaced apart sliding portions formed on its rear or inner surface, though not shown. These sliding portions are slidably engaged with the guide rails 10 to enable the cover 8 to slide back and forth along the bottom portion 7 of the casing 2. The cover 8 may have a plurality of transversely extending parallel ridges 11 formed on the outer surface of its rear portion, so that e.g. a thumb applied to the cover 8 may be caught by the ridges 11 to perform its sliding movement easily.

The cover 8 has an engaging portion formed of a pair of transversely aligned protrusions 13 on its inner surface 12*a* near the front end of the cover. When the device 1 is in its advanced position, the protrusions 13 engage with the front portions of the bottom edges 3*a* of the guide members 3, respectively, on the transfer head 4, as shown in FIG. 3, so that the cover 8 may be held in its advanced position without sliding back inadvertently. The engaging portion may alternatively be formed by a single transversely extending protrusion having a length which is larger than the distance between the guide members 3.

The cover 8 has also a protrusion or shoulder 15 formed on the inner surface of the cover at a rear end portion thereof for abutting a front end 14 of the recess 9 in the bottom portion 7 of the casing 2, as shown in FIG. 3, to prevent any further forward movement of the cover 8 and thereby its separation from the casing 2. The casing 2 has on its bottom portion near its front end a supporting portion formed e.g. of a pair of protrusions 16 for engaging with the protrusions 13 of the cover 8 to hold it in its retracted position in which the device 1 is used, as shown in FIG. 1.

Figure 4:
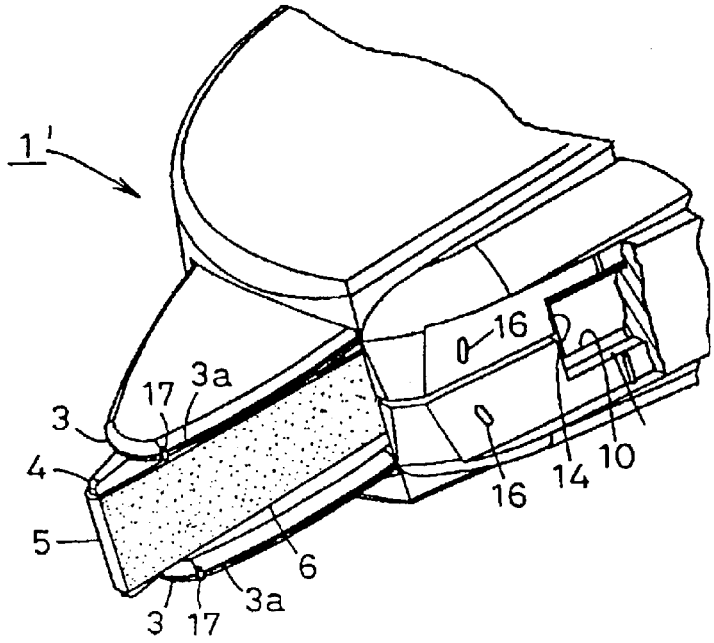
FIG. 4 is a fragmentary perspective view corresponding to FIG. 1, but showing another embodiment of the invention.
Figure 5:
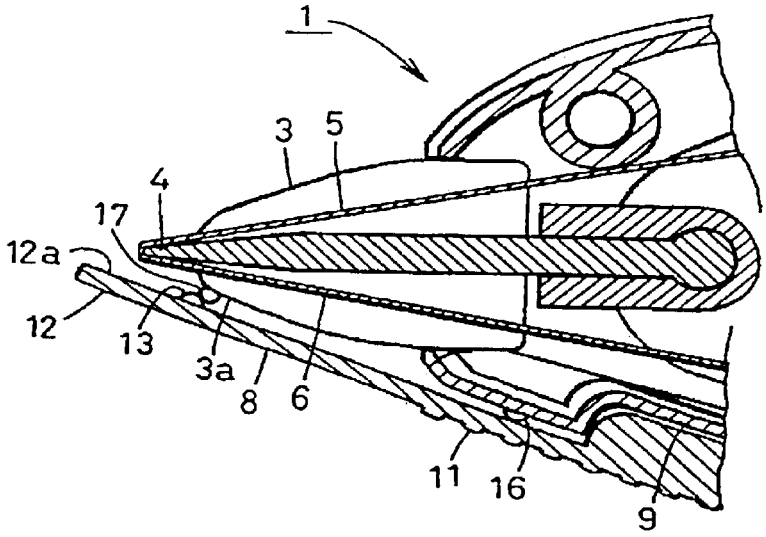
FIG. 5 is a view similar to FIG. 3 of the embodiment of the invention shown in FIG. 4.

Referring now to FIGS. 4 and 5, which show a modified embodiment of a coating transfer device 1' according to the invention, which is essentially identical in construction to the embodiment as described with reference to FIGS. 1 to 3, but distinguishes therefrom by having a pair of protrusions 17 formed on the lower edges 3*a* of the guide members 3, respectively, on the transfer head 4, so that the protrusions 13 formed on the inner surface 12*a* of the front end portion of the protective cover 8 may come in contact with and be moved past the protrusions 17 and stay in front of them when the cover 8 is in its advanced position. The engagement of the protrusions 13 on the cover 8 with the protrusions 17 on the guide members 3 causes an elastic deformation of the front end portion 12 of the cover 8 away from the transfer tape 5 and thereby ensures that an appropriate distance be maintained between the inner surface 12*a* of the cover 8 and the tape 5.

The above description of embodiments of the invention has been given by way of example. From the disclosure given, those skilled in the art will not only understand the present invention and the attendant advantages, but will also find apparent various changes and modifications to the structures disclosed. It is sought, therefore, to cover all such changes and modifications as within the spirit and scope of the invention, as defined by the appended claims, and equivalents thereof.

What is claimed is:

1. A coating transfer device for transferring from the outer surface of a transfer tape a coating onto a surface of a substrate, including a casing, a transfer head around which the transfer tape extends, said transfer head protruding from a casing and having a pair of transversely spaced apart guide members each having a bottom edge, a protective cover held by the casing and being movably between an advanced and a retracted position and having a front end portion adapted to protrude from the casing into the advanced position for protecting the coating on an unused portion of the transfer tape when the device is out of use, said cover having an engaging portion formed on the inner surface of the front end portion for engaging with the bottom edges of the guide members at a front end thereof for holding the cover in the advanced position in which the device is out of use, while the engaging portion is engageable with a supporting portion formed on the casing for hold the cover in the retracted position in which the device is in use.

2. The device according to claim 1, wherein the engaging portion comprises a pair of projections engaging with said guide members to cause the front end portion of the cover to be elastically curved away from the transfer tape to maintain an appropriate distance between the inner surface of the front end portion of the cover and the tape.

3. The device according to claim 1, wherein the engaging portion comprises a projection having a transversely extending length which is larger than the distance between the guide members.

4. The device according to claim 1, wherein the supporting portion is formed on the bottom of the casing which faces the inner surface of the cover.

5. The device according to claim 1, wherein each guide member has on its bottom edge a projection which is engageable with the engaging portion of the cover.

* * * * *